United States Patent [19]

Ishimoto

[11] Patent Number: 4,753,580

[45] Date of Patent: Jun. 28, 1988

[54] FUEL INJECTION PUMP WITH CONTROL ROD SUPPORTED BY A SELF-ALIGNING BEARING

[75] Inventor: Masayori Ishimoto, Higashimatsuyama, Japan

[73] Assignee: Diesel Kiki Co., Ltd., Tokyo, Japan

[21] Appl. No.: 54,319

[22] Filed: May 26, 1987

[30] Foreign Application Priority Data

Jun. 27, 1986 [JP] Japan ..... 61-99411[U]

[51] Int. Cl.[4] ..... F02M 59/28

[52] U.S. Cl. ..... 417/499; 384/906; 123/503

[58] Field of Search ..... 417/494, 499; 123/500, 123/501, 503; 384/206, 207, 207, DIG. 906; 277/136

[56] References Cited

U.S. PATENT DOCUMENTS

| | | | |
|---|---|---|---|
| 839,900 | 1/1907 | Sparrow | 277/136 |
| 1,562,130 | 11/1925 | Stitzinger | 384/206 |
| 2,455,166 | 11/1948 | Firth | 384/906 |
| 2,626,841 | 1/1953 | Potter | 384/206 |
| 2,729,167 | 1/1956 | Links | 123/503 |
| 3,993,369 | 11/1976 | McCloskey | 384/206 |
| 4,576,488 | 3/1986 | Steiner | 384/322 |
| 4,634,299 | 1/1987 | Svensson | 384/206 |

FOREIGN PATENT DOCUMENTS

| | | |
|---|---|---|
| 51-85118 | 12/1974 | Japan . |
| 61-5366 | 11/1986 | Japan . |

*Primary Examiner*—Leonard E. Smith

*Attorney, Agent, or Firm*—Frishauf, Holtz, Goodman & Woodward

[57] ABSTRACT

A fuel injection pump for an internal combustion engine, in which fuel drawn into a pressure chamber is pressure delivered by reciprocating motion of a plunger. A control sleeve slidably fitted on the plunger is axially moved by angular movement of a control rod to vary a prestroke of the plunger. The control rod is supported by a self-aligning bearing fixed in place by a tightening nut within one of a pair of fitting bores formed in a pump housing and a bush disposed within the other fitting bore.

6 Claims, 2 Drawing Sheets

FUEL INJECTION PUMP WITH CONTROL ROD SUPPORTED BY A SELF-ALIGNING BEARING

BACKGROUND OF THE INVENTION

The present invention relates to a fuel injection pump for internal combustion engines and, more particularly, to a fuel injection pump having a prestroke control mechanism.

In recent years, for the purposes of improving the fuel consumption rate of an internal combustion engine and reducing toxic ingredients in the exhaust gases a fuel injection pump has been proposed in which a control sleeve is fitted about a plunger and is axially moved by a control rod to vary the prestroke of the plunger, so that the position of a cam profile of a camshaft used when the fuel is pressure delivered is changed to vary the sliding speed of the plunger, to thereby vary the fuel injection rate. Such fuel injection pump is disclosed, for example, in Japanese Provisional Utility Model Publication (Kokai) No. 61-5366.

In the conventional fuel injection pump described above, as shown in FIG. 1 of the accompanying drawings, a device for supporting the control rod which moves the control sleeve is constructed such that reduced-diameter portions 31*a* and 31*b* of the control rod 31 at opposite ends thereof are respectively inserted in and supported by bores in respective bushes 30 and 30 which are respectively tightly fitted in fitting bores 29 and 29 formed respectively in opposite end walls of a pump housing 1.

In view of the function of the control rod, it is required for the control rod to have no radial and axial plays. To eliminate the radial play, it is desirable to diminish clearance $e_1$ and $e_2$ between thes respective bores in the two bushes 30 and 30 at the opposite ends and the reduced-diameter portions 31*a* and 31*b* of the control rod 31. However, if the clearances $e_1$ and $e_2$ are excessively diminished, there would be a fear that the control rod 31 cannot be fitted into the two bushes 30 and 30 because a slight eccentricity or inclination of the bores. For this reason, it is required to enhance the machining accuracy of the component parts, resulting in increase in the cost. Further, if respective axial clearances $k_1$ and $k_2$ between the axial end faces of the respective bushes 30 and stepped portions 31*c* and 31*d* of the control rod 31 are reduced so as to reduce the axial play, the axial clearances $k_1$ and $k_2$ during the engine operation vary greatly from those during the cooling condition of the engine, because of a difference in material therebetween. Therefore, there would be a fear that the axial clearances are lost during the cooling condition of the engine so that the control rod cannot move angularly. The defect due to the eccentricity of the bores in the respective bushes 30 can be eliminated by the use of an eccentric bush as disclosed in, for example, Japanese Provisional Utility Model Publication (Kokai) No. 51-85118. However, such eccentric bush cannot cope with the axial play.

OBJECT AND SUMMARY OF THE INVENTION

It is an object of the invention to provide a fuel injection pump for an internal combustion engine, in which the opposite ends of the control rod can be supported such that it stably operates, without the necessity of enhancing the machining accuracy of component parts and without being influenced by thermal change.

The present invention provides a fuel injection pump for an internal combustion engine, including a pump housing, a plunger disposed within the pump housing, a pressure chamber defined within the pump housing by the plunger, driving means for causing the plunger to be reciprocated for pressure delivery of fuel drawn into the pressure chamber, a control sleeve slidably fitted on the plunger, a control rod engaging with the control sleeve and being angularly movable to axial move the control sleeve to vary a prestroke of the plunger, and a pair of fitting bores formed in the pump housing, the control rod having opposite ends thereof disposed respectively in the fitting bores.

The fuel injection pump according to the invention is characterized by an improvement comprising:

a self-aligning bearing disposed in one of the fitting bores and supporting associated one of the opposite ends of the control rod;

tightening means for fixing in place the selfaligning bearing in the one fitting bore; and a bush disposed in other fitting bore and supporting the other end of the control rod.

The above and other objects, features, and advantages of the invention will become apparent from the ensuing detailed description taken in conjunction with the accompanying drawings.

DETAILED DESCRIPTION

Figure 2:
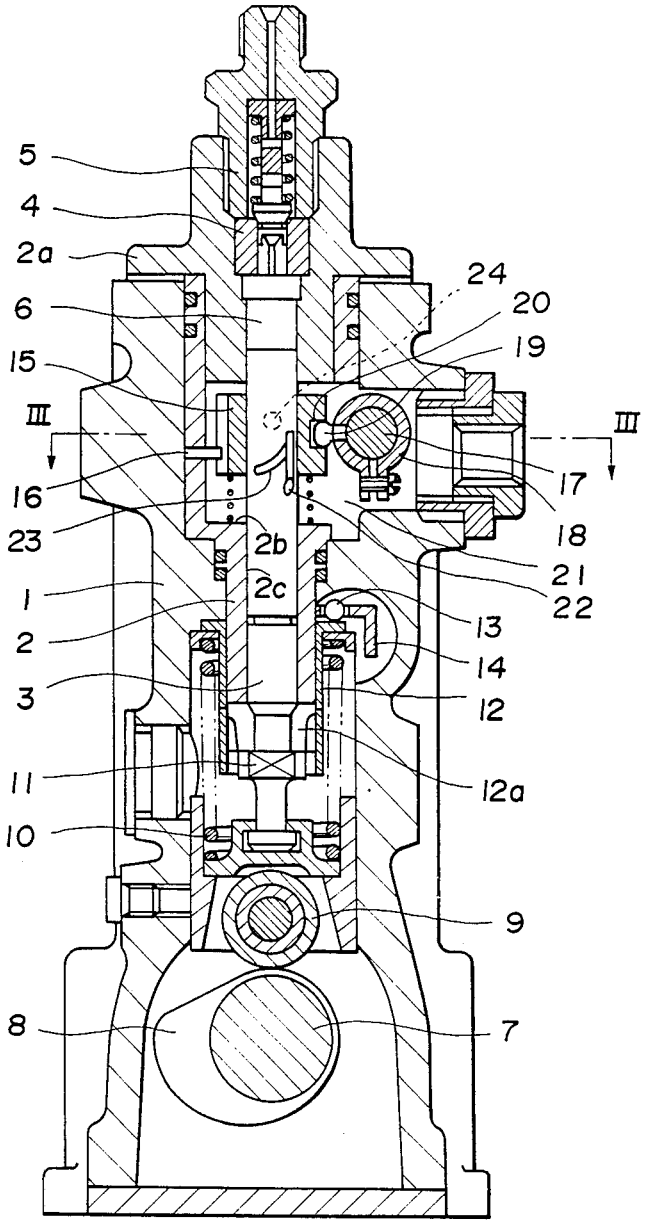
FIG. 2 is a longitudinal cross-sectional view showing an embodiment of a fuel injection pump for an internal combustion engine, according to the invention.

Referring to FIG. 2, there is shown, in longitudinal cross-section, an embodiment of a fuel injection pump for an internal combustion engine.

The fuel injection pump comprises a pump housing 1. A plunger barrel 2 is mounted within an upper half portion of the housing 1. The plunger barrel 2 has at its upper portion an attaching flange 2*a* and at a mid portion a cut-away opening 2*b*. The plunger barrel 2 is formed, along its axis, with a slide bore 2*c* in which a plunger 3 is slidably fitted. A delivery valve 4 is arranged within an upper portion of the slide bore 2*c* in the plunger barrel 2, and is tightened and fixed in place by a holder 5. A pressure chamber 6 filled with fuel is defined between the delivery valve 4 and an upper end face of the plunger 3. A camshaft 7 connected to a drive shaft, not shown, of the engine is rotatably arranged within a lower portion of the pump housing 1. The plunger 3 has its lower end abutting, through a tappet 9, against a cam 8 formed on the camshaft 7. A plunger spring 10 urges the plunger 3 and the tappet 9 against the cam 8. As the camshaft 7 rotates, the plunger 3 and the tappet 9 are reciprocated. A double-flattened portion 11 formed adjacent a lower end portion of the plunger 3 is fitted in a slot 12*a* formed in a lower portion of a control sleeve 12 which is fitted on and guided by an outer periphery of a lower portion of the plunger barrel 2. The control sleeve 12 engages a control rack 14 through a ball 13 fixedly secured to an upper flange of the control sleeve 12. The control rack 14 has one end thereof connected to a governor, not shown. Thus, as the control rack 14 is displaced, the plunger 3 angularly moves to control the amount of fuel to be injected into the engine.

A control sleeve 15 is disposed within the cutaway, mid portion of the plunger barrel 2. The control sleeve 15 is fitted about the plunger 3 for axial sliding therealong and is prevented from angularly moving by a guide pin 1 fitted in the plunger barrel 2. The control sleeve 15 is arranged longitudinally of the pump housing 1 and has its outer peripheral surface formed with an engaging groove 20 which is engaged by an engaging pin 19 on a ring 18. The ring 18 is fitted on and rigidly secured to a control rod 17 for angular movement therewith, which rod has one end connected to an actuator, not shown. Thus, as the control rod 17 angularly moves, the control sleeve 15 is displaced axially of the plunger 3.

The plunger 3 is provided therein with an intake port 22 which always communicates with the pressure chamber 6 and which is so located as to open into a fuel chamber 21 when the plunger 3 assumes a lower position. As the intake port 22 is closed by a lower end edge of the control sleeve 15 during ascending stroke of the plunger 3, pressurizing of the fuel within the pressure chamber 6 is started. Thus, displacement of the control sleeve 15 varies an amount of displacement of the plunger 3 from the bottom dead center thereof until the intake port 22 is closed, that is, a prestroke of the plunger 3. The intake port 22 communicates also with a helical groove 23 for varying the amount of fuel to be injected into the engine. As the helical groove 23 is brought into communication with a spill port 24 formed in the control sleeve 15, the pressurized fuel within the pressure chamber 6 is discharged into the fuel reservoir chamber 21 through the intake port 22 and the helical groove 23, so that the fuel injection is ended.

Figure 1:
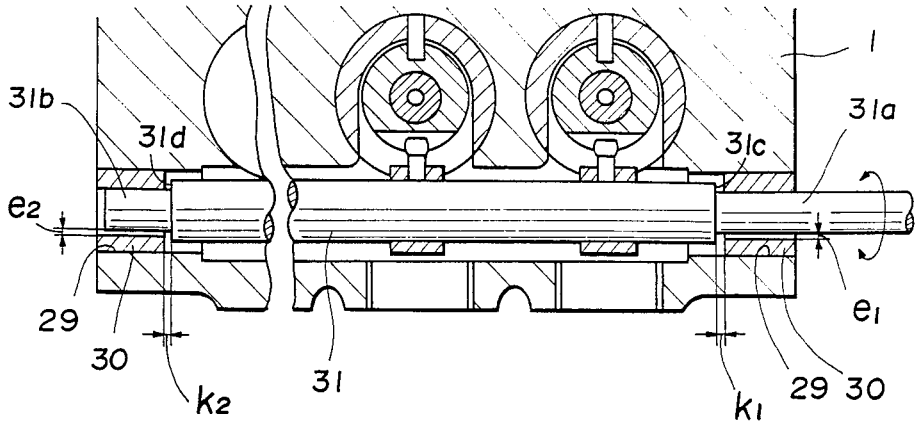
FIG. 1 PRIOR ART
FIG. 1 is a cross-sectional view showing a prestroke control mechanism and its peripheral parts of a conventional fuel injection pump.
Figure 3:
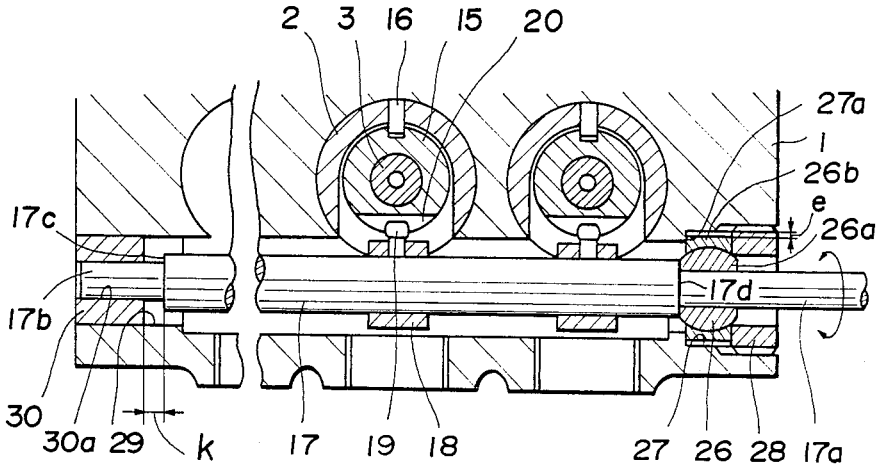
FIG. 3 is a cross-sectional view taken along line III—III in FIG. 1, showing a prestroke control mechanism and its peripheral parts.

FIG. 3 shows essential parts of the fuel injection pump of FIG. 2. A self-aligning bearing 26 has an inner race **26*a* force-fitted on and secured to a reduced-diameter portion 17*a* of the control rod 17 at one end (right hand in the figure) thereof. An outer race 26*b* of the bearing 26 is fitted in a tapped fitting bore 27 formed in one of opposite end walls of the pump housing 1 and is tightened and fixed in place by a tightening nut 28 threadedly fitted in the tapped bore 27. The inner race 26*a* of the bearing 26 has an inner axial end face abutting against a stepped portion 17*d* of the control rod 17 formed adjacent the reduced-diameter portion 17*a*. The outer race 26*b* has an inner axial end face abutting against a stepped portion 27*a* of the fitting bore 27. On the other hand, a reduced-diameter portion 17*b* of the control rod 17 at the other end (left hand in the figure) thereof is slidably inserted in and supported by a bore 30*a* in the cylindrical bush 30 which is force-fitted in and fixed to a fitting bore 29 formed in the other end wall of the pump housing 1**.

With the construction described above, the control rod 17 is prohibited from moving axially by the bearing 26, because the bearing 26 is fixed in an axial position. Accordingly, it is possible to sufficiently increase a gap k between the axial end face of the bush 30 and a stepped portion **17*c* of the control rod 17 so as not to cause any hindrance to occur even if the pump housing 1 expands and contracts due to thermal influence. Moreover, even if the bore 30*a* is eccentrically formed in the bush 30, the position of the bearing 26 can be adjusted so as to be aligned with the bore 30*a* in the bush 30, by providing a clearance e between the one fitting bore 27 in the pump housing 1 and the bearing 26. This greatly facilitates assembling of the component parts, while enabling to minimize the radial clearance between the bore 30*a* and the control rod 17**.

By virtue of the construction described above, the control rod can be prevented from being shifted axially during operation of the control rod, since its axial position is fixed by the self-aligning bearing. In addition, the control rod can never be difficult to angularly move due to thermal influence, and can always be operated smoothly. Furthermore, even if the axis of the bore in the bush is in eccentric or inclined relation to the axis of the bush, the self-aligning bearing can absorb such eccentricity or inclination. This eliminates the necessity of enhancing the machining accuracy of the component parts, thereby facilitating the assembling operation. Thus, there are provided superior advantages in economy and function.

What is claimed is:

1. In a fuel injection pump for an internal combustion engine, including a pump housing, a plunger disposed within said pump housing, a pressure chamber defined within said pump housing by said plunger, driving means for causing said plunger to be reciprocated for pressure delivery of fuel drawn into said pressure chamber, a control sleeve slidably fitted on said plunger, a control rod engaging with said control sleeve and being angularly movable to axially move said control sleeve to vary a prestroke of said plunger, and a pair of fitting bores formed in said pump housing, said control rod having opposite ends which are disposed respectively in said fitting bores, the improvement comprising:

a self-aligning bearing disposed in one of said fitting bores of said pump housing;

said self-aligning bearing comprising an inner race and an outer race;

said inner race having a through-bore formed therethrough, one of said opposite ends of said control rod being axially immovably fitted through said throughbore such that said one end of said control rod is supported by said through-bore of said inner race;

tightening means for fixing in place said outer race of said self-aligning bearing in said one fitting bore; and a bush disposed in the other fitting bore of said pump housing, said bush having a bore in which the other end of said control rod is axially movably fitted such that said last-mentioned bore supports said other end of said control rod.

2. A fuel injection pump as defined in claim 1, wherein a clearance is provided between an outer peripheral surface of said outer race of said self-aligning bearing and said one fitting bore of said pump housing, said clearance extending along the whole axial length of said outer race.

3. A fuel injection pump as defined in claim 1, wherein said inner race of said self-aligning bearing is force-fitted on said one of said opposite ends of said control rod.

4. A fuel injection pump as defined in claim 3, wherein said control rod has a pair of reduced-diameter portions at said opposite ends thereof, and a pair of stepped portions formed respectively adjacent respective ones of said reduced-diameter portions, said self-aligning bearing having an axial end face abutting against one of said stepped portions adjacent one of said reduced-diameter portions to prohibit axial movement of said control rod, said bush having an axial end face axially spaced from the other of said stepped portions to define a gap therebetween, said gap being greater than a maximum amount of deformation of said pump housing which is caused by a change in temperature.

5. A fuel injection pump as defined in claim 1, wherein said one of said fitting bores has an enlarged-tapped portion and a reduced-diameter portion defining therebetween a stepped portion (27*a*) against which said outer race of said self-aligning bearing abuts, said tightening means comprising said stepped portion (27*a*), and a nut threadedly fitted in said enlarged portion and urging said outer race against said stepped portion.

6. A fuel injection pump as defined in claim 5, wherein said nut has a central through-bore formed therein, said nut having such a diameter as to allow axial angular movement of said inner race of said self-aligning bearing.

* * * * *